US006040698A

United States Patent [19]

Takahashi et al.

[11] Patent Number: 6,040,698

[45] **Date of Patent: *Mar. 21, 2000**

[54] COMBUSTION STATE DETECTING APPARATUS FOR AN INTERNAL-COMBUSTION ENGINE

[75] Inventors: Yasuhiro Takahashi; Wataru Fukui, both of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/890,020

[22] Filed: Jul. 10, 1997

[30] Foreign Application Priority Data

Feb. 18, 1997 [JP] Japan ..... 9-033965

[51] Int. Cl.[7] ..... F02P 17/00

[52] U.S. Cl. ..... 324/399; 324/378

[58] Field of Search ..... 324/399, 388, 324/378; 123/425; 73/116, 35.01

[56] References Cited

U.S. PATENT DOCUMENTS

| | | | |
|---|---|---|---|
| 5,207,200 | 5/1993 | Iwata | 123/425 |
| 5,230,240 | 7/1993 | Ohsawa | 73/116 |
| 5,272,914 | 12/1993 | Murata | 73/116 |
| 5,424,647 | 6/1995 | Ohsawa et al. | 324/378 |
| 5,483,818 | 1/1996 | Brandt | 73/35.01 |

FOREIGN PATENT DOCUMENTS

| | | |
|---|---|---|
| 4-191466 | 7/1992 | Japan . |
| 6-207574 | 7/1994 | Japan . |

*Primary Examiner*—Josie Ballato
*Assistant Examiner*—Russell M. Kobert
*Attorney, Agent, or Firm*—Sughrue, Mion, Zinn, Macpeak & Seas, PLLC

[57] ABSTRACT

A combustion state detecting apparatus for an internal-combustion engine does not incur deteriorated ignition characteristics because the ionic current detecting circuit thereof is not affected by ignition current. The combustion state detecting apparatus is equipped with an ionic current detecting circuit (10A) which includes a biasing device (C) connected to the low voltage end of a secondary winding (2*b*) of an ignition coil (2) and which detects ionic current (i) flowing from the biasing device via a spark plug (4); rectifying device (5) which is inserted between the biasing device and the secondary winding so that the ionic current flows in the forward direction; a voltage clamping device (6) inserted between the secondary winding and the ground; and an ECU (20) which detects the combustion state according to the ionic current. The biasing device applies a bias voltage (VBi) of the opposite polarity from the high voltage for ignition to the spark; and the voltage clamping device limits a voltage (Vc) at the low voltage end of the secondary winding to a predetermined value when the high voltage for ignition appears, the absolute value of the predetermined value being set to the absolute value or more of the bias voltage.

5 Claims, 6 Drawing Sheets

COMBUSTION STATE DETECTING APPARATUS FOR AN INTERNAL-COMBUSTION ENGINE

BACKGROUND OF THE INVENTION

1. Field of the Invention

The present invention relates to an apparatus for detecting the combustion state of an internal-combustion engine by detecting the changes in the quantity of ions, which are produced at the time of combustion of the internal-combustion engine, through the low voltage end of a secondary winding of-an ignition coil and, more particularly, to a combustion state detecting apparatus for an internal-combustion engine which prevents a failure or the like of an ionic current detecting circuit from affecting secondary current during ignition control so as to protect ignition characteristics from deterioration.

2. Description of Related Art

Generally, in an internal-combustion engine driven by a plurality of cylinders, a fuel-air mixture composed of fuel and air which has been introduced into the combustion chamber of each cylinder is compressed as a piston moves up, and high voltage for ignition is applied to a spark plug installed in the combustion chamber to generate an electric spark so as to burn the fuel-air mixture; the explosive force produced when the fuel-air mixture is burnt is converted to the force which pushes the piston down is taken out as a rotary output of the internal-combustion engine.

It is known that, when the combustion takes place in the combustion chamber, the molecules in the combustion chamber are ionized, and therefore, applying bias voltage to ionic current detecting electrodes, which are usually spark plug electrodes and which are installed in the combustion chamber, causes ions with electric charges to move in the form of ionic current between spark plug electrodes.

It is also known that the ionic current sensitively reacts to the combustion state in the combustion chamber, making it possible to detect a combustion state in the internal-combustion engine by detecting the state in which the ionic current is generated.

This type of combustion state detecting apparatus for an internal-combustion engine is described in, for example, Japanese Unexamined Patent Publication No. 4-191465 or No. 7-217519 wherein a spark plug is employed as the electrode for detecting ionic current, and a combustion failure including a misfire is detected from the quantity of ionic current detected immediately after ignition.

FIG. 5 is a circuit configuration diagram illustrative of an example of a conventional combustion state detecting apparatus for an internal-combustion engine; it shows an example of an independent ignition apparatus wherein one ionic current detecting circuit is connected for the ignition coil corresponding to one cylinder.

In FIG. 5, the cathode of an in-car battery 1 is connected to one end of a primary winding 2*a* of an ignition coil 2, the other end of the primary winding 2*a* being connected to the ground via an emitter-grounded power transistor 3 for cutting off the supply of primary current.

A secondary winding 2*b* of the ignition coil 2 constitutes, together with the primary winding 2*a*, a transformer; the high voltage end of the secondary winding 2*b* is connected to one end of a spark plug 4 corresponding to each cylinder, not shown, to output high voltage of negative polarity at the time of ignition control.

The spark plug 4 composed of opposed electrodes discharges to ignite the fuel-air mixture in a cylinder when the high voltage for ignition is applied thereto.

In this drawing, only a pair of the ignition coil 2 and the spark plug 4 are shown as a representative of those ignition coils 2 and spark plugs 4 which are provided for respective cylinders.

The low voltage end of the secondary winding 2*b* is connected to an ionic current detecting circuit 10. The ionic current detecting circuit 10 applies a bias voltage of positive polarity, which is the opposite polarity from the ignition polarity, to the spark plug 4 via the secondary winding 2*b* and it detects the ionic current which corresponds to the quantity of ions generated at the time of combustion.

The ionic current detecting circuit 10 includes: a biasing means, namely, a capacitor C connected to the low voltage end of the secondary winding 2*b*; a diode D inserted between the capacitor C and the ground; a resistor R connected in parallel to the diode D; and a zener diode DZ for limiting voltage which is connected in parallel to the capacitor C and the diode D.

The series circuit composed of the capacitor C and the diode D and the zener diode DZ connected in parallel to the series circuit are inserted between the low voltage end of the secondary winding 2*b* and the ground to constitute a charging path for charging the capacitor C with the bias voltage at the time when ignition current is produced.

The capacitor C is charged with the secondary current which flows via the spark plug 4 discharged under the high voltage output from the secondary winding 2*b* when the power transistor 3 is turned OFF, i.e. when the current supplied to the primary winding 2*a* is cut off. The charging voltage is limited to a predetermined bias voltage, e.g. a few hundred volts, by the zener diode DZ; it functions as the biasing means, i.e. the power supply, for detecting ionic current.

The resistor R in the ionic current detecting circuit 10 converts the ionic current provided by the bias voltage to a voltage which is supplied as an ionic current detection signal Ei to an electronic control unit (ECU) 20.

The ECU 20 comprised of a microprocessor determines the combustion state of the internal-combustion engine according to the ionic current detection signal Ei; if it detects a bad combustion state, then it carries out appropriate corrective measures to prevent a problem.

The ECU 20 also computes the ignition timing, etc. according to the operating conditions obtained through various sensors, not shown, and issues an ignition signal P for the power transistor 3, fuel injection signals to the injectors, not shown, of the respective cylinders, and driving signals to various actuators such as a throttle valve and an ISC valve.

FIG. 6 and FIG. 7 are explanatory drawings illustrative of the path along which current flows into the secondary winding 2*b* and the ionic current detecting circuit 10; FIG. 6 illustrates the path, which is indicated by the solid line, of secondary current I2 flowing under the high voltage at the time when the spark plug 4 discharges, that is, during the ignition control; and FIG. 7 illustrates the path, which is indicated by the dashed line, of ionic current i running under the bias voltage at the time when the ionic current is detected.

Referring now to FIG. 6 and FIG. 7, the operation of the conventional combustion state detecting apparatus for an internal-combustion engine shown in FIG. 5 will be described.

Normally, the ECU 20 computes the ignition timing, etc. according to operating conditions and applies the ignition signal P to the base of the power transistor 3 at a target control timing so as to turn the power transistor 3 ON/OFF.

Thus, the power transistor 3 cuts off the supply of the primary current flowing into the primary winding 2*a* of the ignition coil 2 in order to boost the primary voltage and to generate the high voltage, e.g. a few tens of kilovolts, for ignition at the high voltage end of the secondary winding 2*b*.

This secondary voltage is applied to the spark plug 4 in each cylinder to generate a discharge spark in the combustion chamber of the cylinder under ignition control, thereby burning the fuel-air mixture. At this time, if the combustion state is normal, then a predetermined quantity of ions are produced around the spark plug and in the combustion chamber.

During the ignition control, the secondary current I2 triggered by the discharge of the spark plug 4 at the time of ignition flows along the path indicated by the solid line shown in FIG. 6 and charges the capacitor C, which provides the bias power supply, via the charging path in the ionic current detecting circuit 10.

Then, as soon as the bias voltage of the capacitor C exceeds the zener voltage of the zener diode DZ, the secondary current I2 flows along the path on the zener diode DZ side, and the bias voltage of the capacitor C is limited by the zener voltage of the zener diode DZ. The bias voltage of the capacitor C is set to an arbitrary predetermined value by the circuit characteristic of the zener diode DZ.

The bias voltage thus charged in the capacitor C is applied to the spark plug 4 of a cylinder which has just been subjected to the ignition control, i.e. combustion, via the secondary winding 2*b*, causing the ionic current i, which corresponds to the quantity of ions produced at the time of combustion, flows as indicated by the dashed line in FIG. 7. At this time, the ions move between the electrodes of the spark plug 4, and the capacitor C discharges.

The ionic current i is detected as the ionic current detection signal Ei by the voltage drop across the resistor R. The ECU 20 determines the combustion state of each cylinder according to the ionic current detection signal Ei and computes appropriate control parameters such as ignition timings in accordance with the operating conditions and the combustion states as previously described.

However, since the path of the secondary current I2 which flows during the ignition control includes the ionic current detecting circuit 10, various problems related to the ionic current detecting circuit 10 inevitably affect ignition characteristics.

For instance, if a connecting harness between the ignition coil 2 and the ionic current detecting circuit 10 should be disconnected or the ionic current detecting circuit 10 itself should fail, then normal flow of the secondary current I2 is prevented, adversely affecting the igniting operation.

Thus, the conventional combustion state detecting apparatus for an internal-combustion engine has been posing a problem in that, since it includes the ionic current detecting circuit 10 in the path of the secondary current I2 which flows during ignition control, diverse problems relevant to the ionic current detecting circuit 10 unavoidably affect the secondary current I2, leading to a danger of damaging the soundness of the secondary current I2 with a resultant control error.

SUMMARY OF THE INVENTION

The present invention has been made with a view toward solving the problem described above, and it is an object of the invention to provide a combustion state detecting apparatus for an internal-combustion engine, which apparatus is capable of preventing a failure or the like of an ionic current detecting circuit from affecting secondary current during ignition control so as to protect ignition characteristics from deterioration.

To this end, according to the present invention, there is provided a combustion state detecting apparatus for an internal-combustion engine, which apparatus is equipped with: an ignition coil composed of a transformer which has a primary winding and a secondary winding, and which generates a high voltage for ignition at the high voltage end of the secondary winding when the supply of current to the primary winding is cut off; a spark plug which is composed of opposed electrodes connected to the high voltage end of the secondary winding and which discharges under the application of the high voltage for ignition to ignite the fuel-air mixture in a cylinder of the internal-combustion engine; an ionic current detecting circuit which includes biasing means connected to the low voltage end of the secondary winding and which detects ionic current flowing from the biasing means via the spark plug after the combustion of the fuel-air mixture; a rectifying means which is inserted between the biasing means and the low voltage end of the secondary winding so that the ionic current flows in the forward direction; a voltage clamping means inserted between the low voltage end of the secondary winding and the ground; and an ECU which detects the combustion state at a spark plug according to the ionic current; wherein the biasing means applies a bias voltage of the opposite polarity from the high voltage for ignition to the spark plug via the rectifying means and the secondary winding; and the voltage clamping means limits the voltage at the low voltage end of the secondary winding to a predetermined value when the high voltage for ignition appears, the absolute value of the predetermined value being set to the absolute value or more of the bias voltage of the biasing means.

The voltage clamping means of the combustion state detecting apparatus for an internal-combustion engine in accordance with the present invention includes a zener diode connected in the opposite polarity in relation to the secondary current flowing through the secondary winding under the high voltage for ignition.

In a preferred form of the invention, the voltage clamping means of the combustion state detecting apparatus for an internal-combustion engine includes a diode connected in series so that it carries the opposite polarity in relation to the zener diode.

In another preferred form of the invention, the biasing means of the combustion state detecting apparatus for an internal-combustion engine is comprised of a capacitor which is charged with primary current flowing through the primary winding, and the ionic current detecting circuit includes a diode having the anode thereof connected to the low voltage end of the primary winding, and a resistor inserted between the cathode of the diode and the high voltage terminal of the capacitor.

In yet another preferred form of the invention, the combustion state detecting apparatus for an internal-combustion engine has current limiting means installed between the junction of the rectifying means and the voltage clamping means and the low voltage end of the secondary winding; wherein the current liming means controls the current flowing from the biasing means to the spark plug via the secondary winding so as to control the voltage appearing at the high voltage end of the secondary winding at the start of supplying current to the primary winding.

In another preferred form of the present invention, the current limiting means of the combustion state detecting apparatus for an internal-combustion engine includes a resistor and a diode connected in parallel to the resistor; wherein the diode sets the direction of the secondary current flowing through the secondary winding at the time of applying the high voltage for ignition to the forward direction so as to suppress the potential difference across the resistor during ignition control.

The combustion state detecting apparatus for an internal-combustion engine according to the present invention is equipped with a distributor installed between the high voltage end of the secondary winding and the spark plug; wherein the distributor includes a central electrode connected to the high voltage end of the secondary winding, a plurality of peripheral electrodes individually connected to the spark plugs of respective cylinders, a rotary electrode which rotates around the central electrode as the internal-combustion engine rotates and which is opposed to the peripheral electrodes in sequence with a gap therebetween, and a plurality of high voltage diodes individually provided between the central electrode and the respective peripheral electrodes so as to make ionic current flow in the forward direction.

In a preferred form of the present invention, the ignition coils and spark plugs of the combustion state detecting apparatus for an internal-combustion engine are provided for the respective cylinders of the internal-combustion engine, and the voltage clamping means and the ionic current detecting circuit are commonly connected to the low voltage ends of the secondary windings of the respective ignition coils.

DESCRIPTION OF THE PREFERRED EMBODIMENTS

First Embodiment

A first embodiment of the present invention will be described with reference to the accompanying drawings, taking as an example the internal-combustion engine apparatus of independent ignition system mentioned above.

Figure 1:
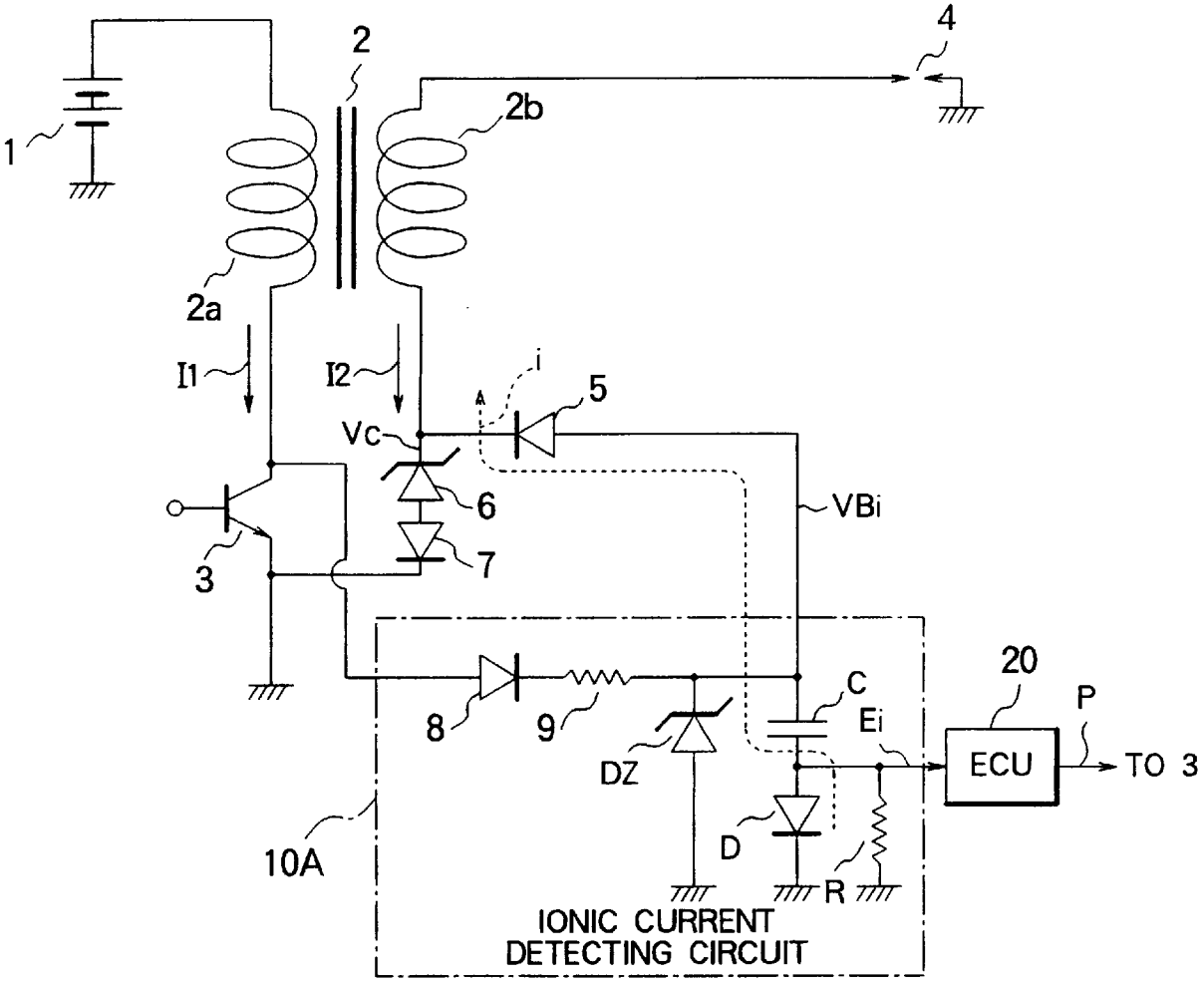
FIG. 1 is a circuit block diagram showing a first embodiment of the present invention.
Figure 5:
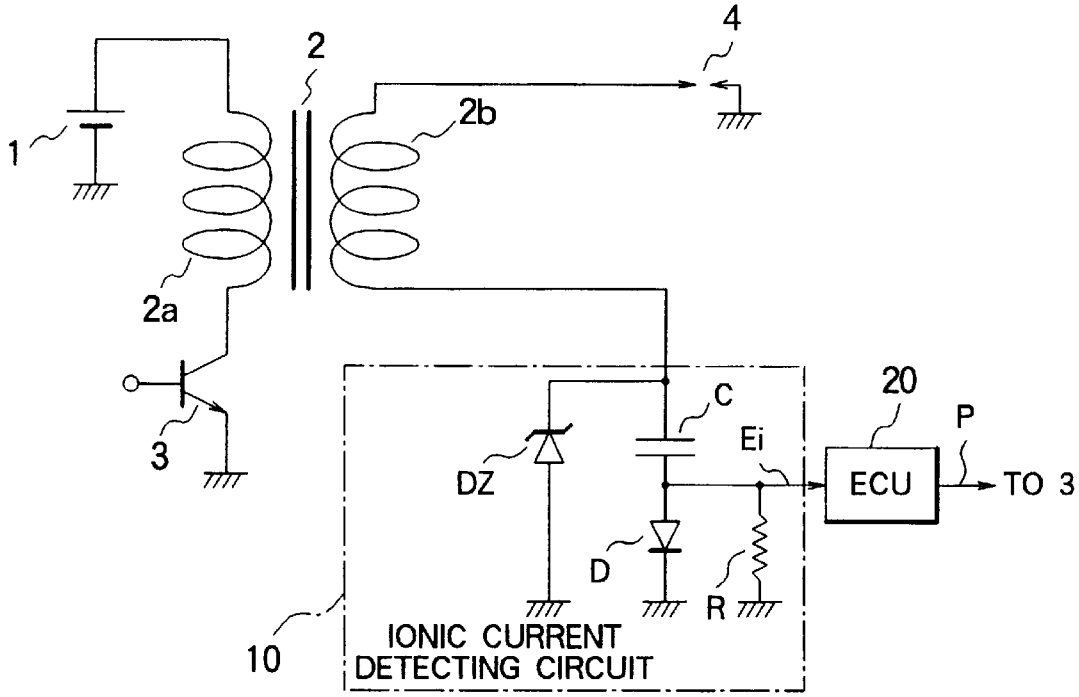
FIG. 5 PRIOR ART
FIG. 5 is a circuit block diagram illustrating a conventional combustion state detecting apparatus for an internal-combustion engine.
Figure 6:
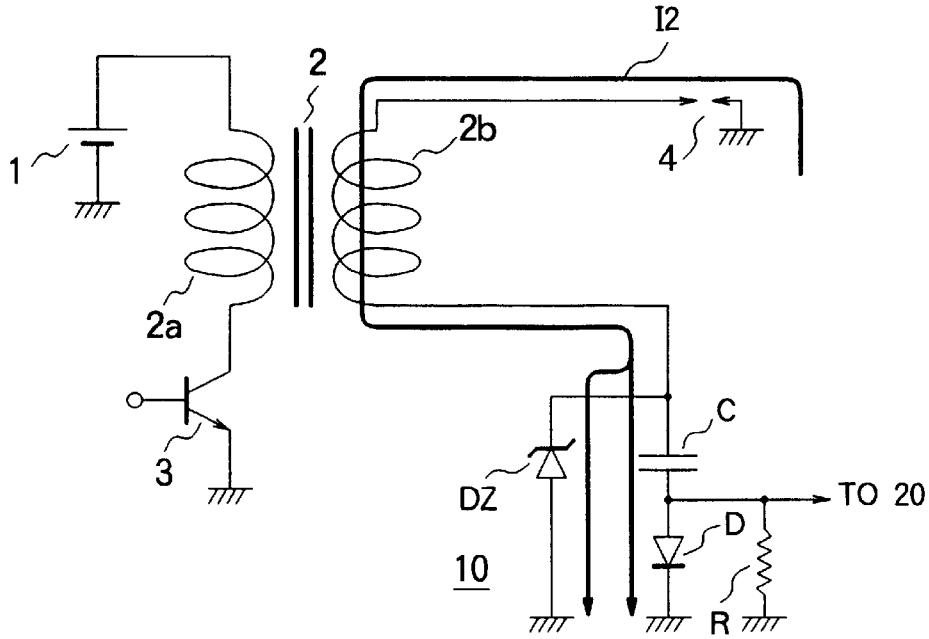
FIG. 6 PRIOR ART
FIG. 6 is an explanatory diagram illustrative of a secondary current path observed during the ignition control by the conventional combustion state detecting apparatus for an internal-combustion engine.
Figure 7:
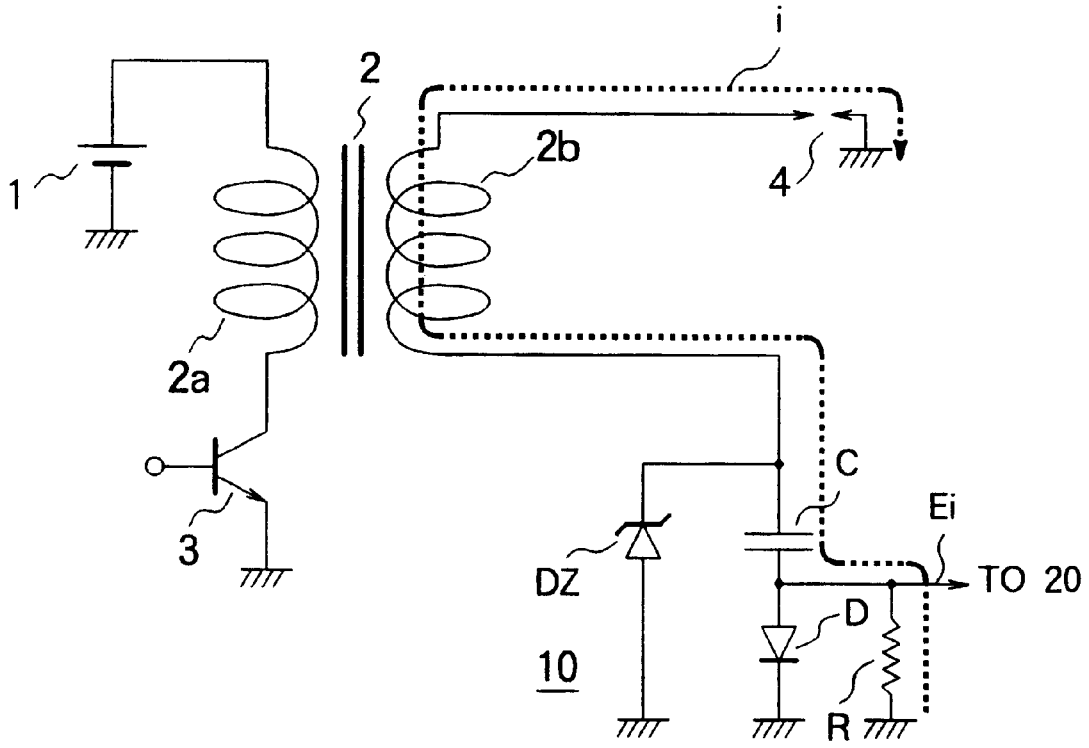
FIG. 7 PRIOR ART
FIG. 7 is an explanatory diagram illustrative of an ionic current path observed during the ionic current detection by the conventional combustion state detecting apparatus for an internal-combustion engine.

FIG. 1 is a block diagram illustrating the first embodiment of the invention; like composing elements as those described above (see FIG. 5) will be assigned like reference numerals and the detailed description thereof will be omitted.

In FIG. 1, a diode 5 for preventing backflows which sets the flow of ionic current i in the forward direction, is inserted between the low voltage end of a secondary winding 2*b* and a capacitor C, i.e. biasing means, in an ionic current detecting circuit 10A.

The low voltage end of the secondary winding 2*b* of the ignition coil 2 is grounded via a voltage clamping means constituted by a zener diode 6 and a diode 7.

The zener diode 6 is connected in the opposite polarity with respect to the secondary current I2 flowing through the secondary winding 2*b* under the high voltage for ignition so as to limit the voltage at the low voltage end of the secondary winding 2*b* at the time when the high voltage for ignition is produced to a predetermined value, namely, clamping voltage Vc. The absolute value of the clamping voltage Vc is set to the absolute value or more of bias voltage VBi of the capacitor C.

The diode 7 is connected in series so that it carries the opposite polarity in relation to the zener diode 6 to prevent the backflow from the ground.

The ionic current detecting circuit 10A includes a diode 8 which has the anode thereof connected to the low voltage end of a primary winding 2*a* and a resistor 9 for limiting current which is inserted between the cathode of the diode 8 and the high voltage terminal of a capacitor 8 serving as a biasing means; the capacitor C is charged by primary current I1 flowing through the primary winding 2*a*.

A zener diode DZ is connected in parallel to both terminals of the capacitor C, the anode thereof being grounded via a diode D. This prevents the leakage current attributable to the temperature characteristics of the zener diode DZ from flowing into a resistor R for detecting ionic current, thus preventing detection errors.

The operation of the first embodiment of the invention shown in FIG. 1 will now be described.

As previously mentioned, when a power transistor 3 is turned ON by an ignition signal P received from an ECU 20, the primary current I1 flowing through the primary winding 2*a* is cut off.

At this time, as the ignition signal P switches from high level to low level to cause the power transistor 3 to cut off the primary current I1, a relatively high primary voltage of the positive polarity appears at the low voltage end of the primary winding 2*a*, i.e. the collector of the power transistor 3.

This primary voltage causes current to flow along a path composed of the diode 8, the resistor 9, the capacitor C, the diode D, and the ground in the order in which they are listed, thus charging the capacitor C.

When the charging voltage of the capacitor C becomes equal to the sum of the forward voltage drop of the diode D and the zener voltage of the zener diode DZ, i.e. the bias voltage VBi, the charging of the capacitor C is completed.

After that, the primary current I1 flows along a path composed of the diode 8, the resistor 9, the zener diode DZ, the diode D, and the ground in the order in which they are listed.

When the primary current I1 is cut off, secondary voltage, namely, the high voltage for ignition, of the negative polarity appearing at the high voltage end of the secondary winding 2*b* causes spark discharge to take place at a spark plug 4, thus burning a fuel-air mixture.

At this time, the secondary current I2 flows along a path composed of the ground, the spark plug 4, the secondary winding 2*b*, the zener diode 6, the diode 7, and the ground in the order in which they are listed.

The secondary current I2 causes the cathode potential of the zener diode 6 to increase to the sum, namely, a clamping voltage Vc, of the forward voltage drop of the diode 7 and the zener voltage of the zener diode 6.

The relationship between the bias voltage VBi charged in the capacitor C and the cathode potential of the zener diode 6, i.e. the clamping voltage Vc, is related to forward voltage drop V5 of the diode 5; it is set to satisfy equation (1) shown below:

$$Vc+V5>VBi \quad (1)$$

Hence, while the secondary current I2 is being supplied, that is, while the primary current I1 is OFF, the diode 5 stays OFF; therefore, the accumulated charges of the capacitor C are not released, causing no drop in the bias voltage.

The clamping voltage Vc should be set to a relatively small value to an extent where equation (1) is satisfied in order to minimize the delay in the timing for starting the detection of ionic current i, which will be discussed later.

While the spark plug 4 is discharging during ignition control, the absolute value of the voltage at the high voltage end of the secondary winding 2*b* drops from a few tens of kilovolts in minus at the start of the discharge to a few kilovolts in minus. Upon completion of the discharge, the clamping voltage Vc, e.g. about 200 volts, of the positive polarity is obtained.

Thus, as the fuel-air mixture is burnt by the discharge of the spark plug 4, the clamping voltage Vc causes ionic current to flow by using the ions generated in the combustion chamber as the media.

At this time, the ionic current is triggered by the clamping voltage Vc supplied from the cathode of the zener diode 6, and the clamping voltage Vc drops to satisfy equation (2) given below:

$$Vb+V5=Va \quad (2)$$

From this moment, the ionic current (indicated by the dashed line) starts to flow under the bias voltage VBi of the capacitor C, then the bias voltage VBi and the clamping voltage Vc drop; however, the ionic current i continues to flow while satisfying equation (2).

At this time, the ionic current i flows along a path composed of the ground, the resistor R, the capacitor C, the diode 5, the secondary winding 2*b*, the spark plug 4, and the ground in the order in which they are listed.

The resistor R outputs ionic current detection signal Ei, and the ECU 20 determines the combustion state according to the ionic current detection signal Ei.

Thus, the path of the secondary current I2 during ignition control does not include the ionic current detecting circuit 10A; therefore, such problems as circuit failures or connection failures related to the ionic current detecting circuit 10A do not affect ignition characteristics, enabling a lower occurrence rate of failures of the igniting device with consequent higher reliability of the ignition.

The ionic current i can be smoothly detected from the low voltage end of the secondary winding 2*b* without adding to cost simply by adding the diode 5, the zener diode 6, and the diode 7 to the ignition coil 2.

The diode 7 of the opposite polarity has been connected in series to the zener diode, so that interferences from other circuits can be positively prevented.

The ignition device is so designed that, even when the bias voltage VBi for detecting ionic current must be applied from the low voltage end of the secondary winding 2*b*, the primary current I1 from the counter electromotive voltage of the primary winding 2*a* can be used for the charge of the bias voltage VBi rather than using the secondary current I2.

The capacitor C can be charged using the primary current I1, obviating the need for the DC power supply for providing the bias voltage.

Second Embodiment

In the first embodiment described above, for the bias voltage VBi for detecting the ionic current, the capacitor C charged with the counter electromotive voltage of the primary winding 2*a* at the time of ignition control has been employed; however, a regular DC power supply may be employed instead.

Using a regular DC power supply enables the elimination of the diode 8, the resistor 9, and the zener diode DZ from the capacitor charging circuit, i.e. the ionic current detecting circuit 10A.

Third Embodiment

In the first embodiment above, no special consideration has been given to the discharge of the bias voltage VBi at the start of supplying the primary current I1; a current limiting means for preventing the discharge of the bias voltage VBi at the start of supplying the current may be added.

Usually, at the start of energizing the primary winding 2*a*, the voltage of the positive polarity, i.e. the voltage of the opposite polarity from that at the ignition, is generated at the high voltage end of the secondary winding 2*b*. Hence, if the bias voltage is superimposed on the generated voltage, then the spark plug 4 may discharge, resulting in pre-ignition. For this reason, it is desirable to add the current limiting means to the low voltage end of the secondary winding 2*b* to prevent pre-ignition and the discharge of the bias voltage VBi.

Figure 2:
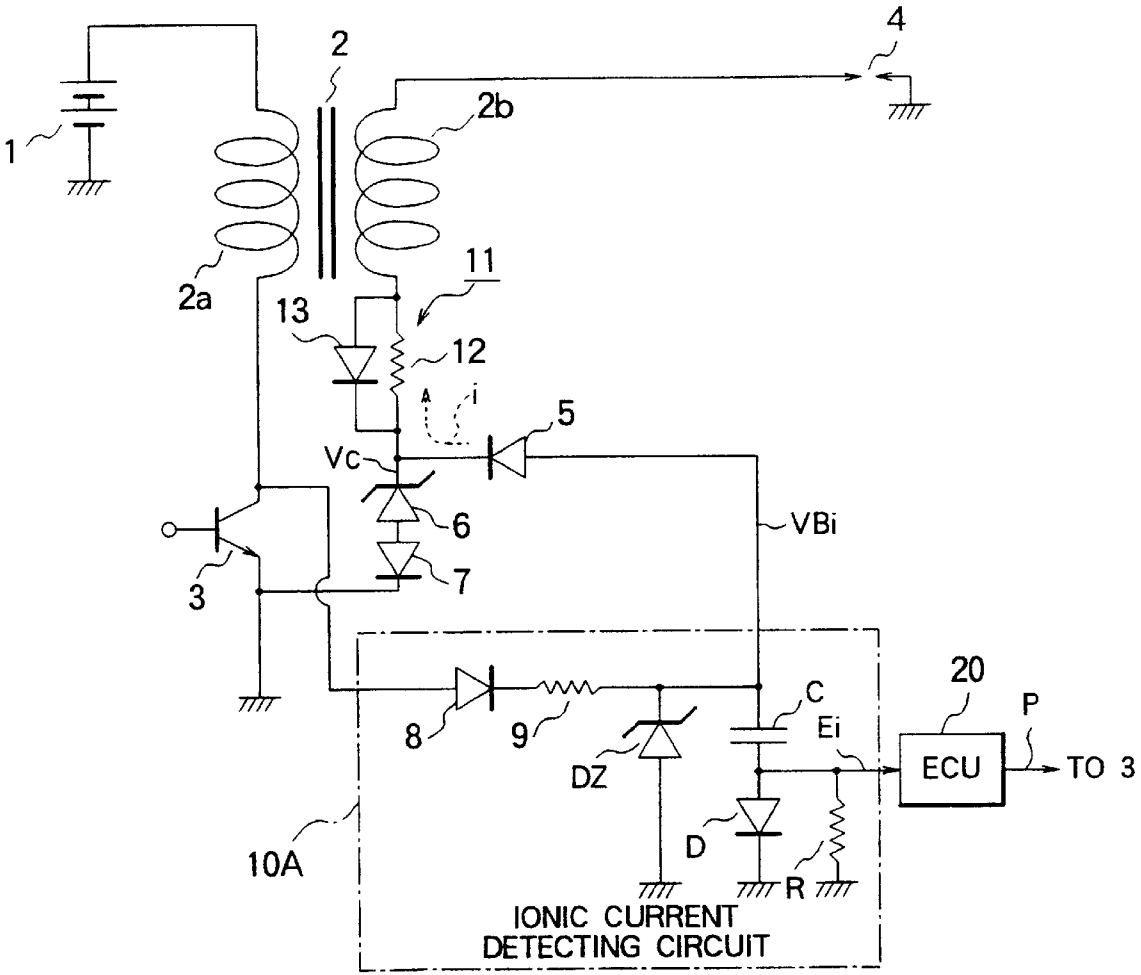
FIG. 2 is a circuit block diagram illustrating a third embodiment of the invention.

FIG. 2 is a circuit block diagram illustrating a third embodiment of the invention which is provided with the current limiting means for preventing the discharge of the bias voltage; like components as those in FIG. 1 are assigned like reference numerals and the detailed description thereof will be omitted.

In FIG. 2, a current limiting means 11 composed of a parallel circuit including a resistor 12 and a diode 13 is provided between the junction of the diode 5 and the zener diode 6 and the low voltage end of the secondary winding 2*b*.

The resistor 12 constituting the current limiting means 11 restricts the discharge current flowing into the spark plug 4 from the capacitor C via secondary winding 2*b*; it controls the voltage generated at the high voltage end of the secondary winding 2*b* at the start of energizing the primary winding 2*a* so as to prevent the spark plug 4 from discharging, i.e. pre-ignition.

Since the discharge of the capacitor C is prevented, the bias voltage is maintained at a sound value, preventing the sensitivity for detecting the ionic current i from being deteriorated.

It is also possible to prevent erroneous detection of the ionic current detection signal Ei attributed to premature discharge of the bias voltage VBi.

The diode 13 connected in parallel to the resistor 12 has its forward direction set to the direction of the secondary current I2 which flows through the secondary winding 2*b* at the time when the high voltage for ignition is applied, so that it restrains the potential difference across the resistor 12 during ignition control.

Thus, since the secondary current I2 flows through the diode 13, the current limiting function of the resistor 12 is rendered invalid, causing no deterioration in the ignition characteristics.

As described above, the addition of the current limiting means 11 prevents pre-ignition or a drop in the bias voltage VBi. This makes it possible to obtain highly accurate ionic current detection signal Ei which ensures highly reliable determination results of combustion states.

Fourth Embodiment

In the foregoing first through third embodiments, the example in which the low voltage is distributed to the spark plug 4 has been described. The present invention, however, may also be applied to an internal-combustion engine of a high voltage distribution system in which a distributor is installed between the ignition coil and each spark plug.

Figure 3:
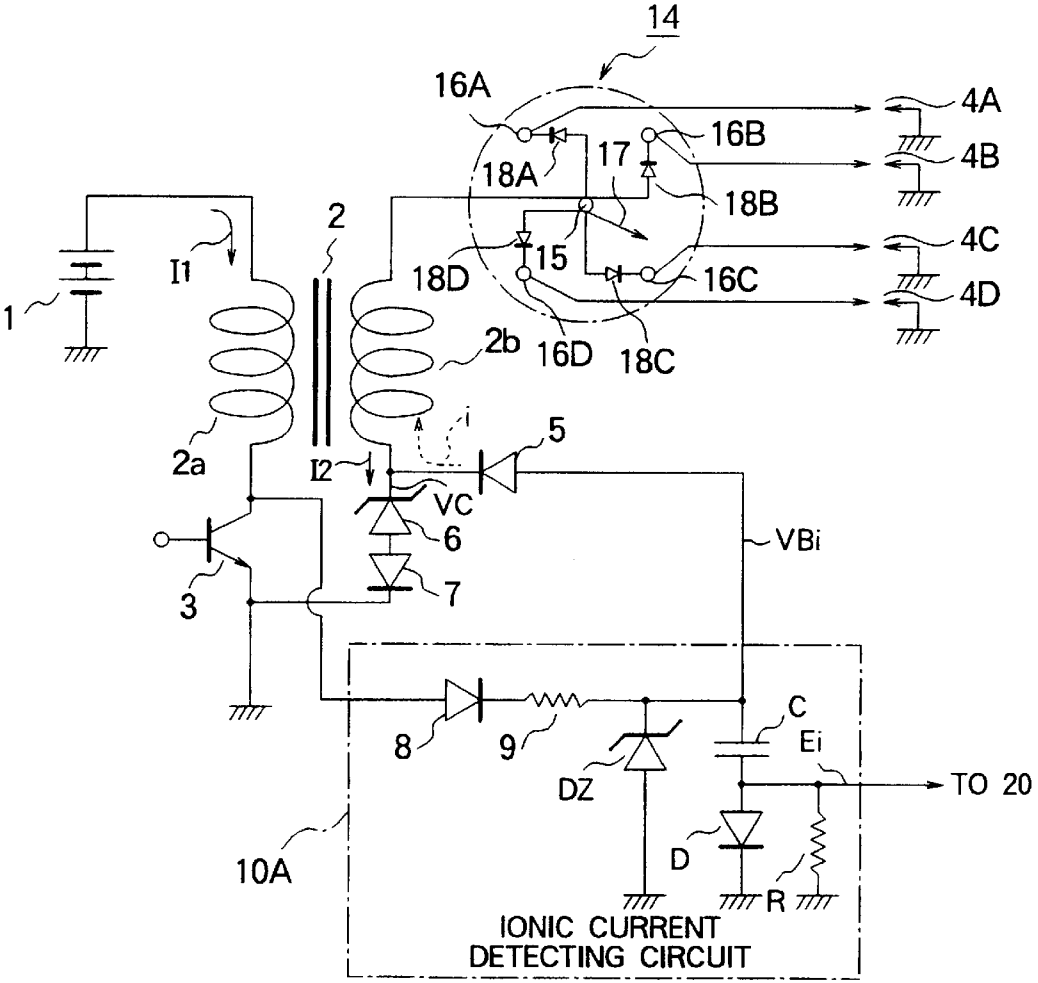
FIG. 3 is a circuit block diagram illustrating a fourth embodiment of the invention.

FIG. 3 is a circuit block diagram illustrative of a fourth embodiment of the invention applied to a four-cylinder high voltage distribution apparatus; like components as those shown in FIG. 1 will be given like reference numerals and the description thereof will be omitted.

In FIG. 3, a distributor 14 is provided between the high voltage end of the secondary winding 2*b* and spark plugs 4A through 4D.

The distributor 14 includes: a central electrode 15 connected to the high voltage end of the secondary winding 2b; a plurality of (four in this embodiment) peripheral electrodes 16A through 16D individually connected to the spark plugs 4A through 4D of each cylinder; a rotary electrode 17 which rotates around the central electrode 15 as the internal-combustion engine rotates and which is opposed to the peripheral electrodes 16A through 16D in sequence with a gap provided therebetween; and four high voltage diodes 18A through 18D individually installed between the central electrode 15 and the respective peripheral electrodes 16A through 16D so that the ionic current i flows in the forward direction.

In this case, the secondary voltage appearing at the secondary winding 2*b* when the primary current I1 is cut off is distributed to the respective spark plugs 4A through 4D each time the rotary electrode 17 in the distributor 14 faces against one of the peripheral electrodes 16A through 16D, thereby burning a fuel-air mixture by spark discharge.

At this time, if attention is paid only to, for example, the spark plug 4A, then the secondary current I2 flows along a path composed of the ground, the spark plug 4A, the peripheral electrode 16A, the rotary electrode 17, the central electrode 15, the secondary winding 2*b*, the zener diode 6, the diode 7, and the ground in the order in which they are listed.

Then, when the ionic current flowing via the spark plug 4A after combustion causes the clamping voltage Vc to drop to a value which satisfies the foregoing equation (2), the ionic current i via the capacitor C (indicated by the dashed line) flows along a path composed of the ground, the resistor R, the capacitor C, the diode 5, the secondary winding 2*b*, the central electrode 15, the diode 18A, the ignition plug 4A, and the ground in the order in which they are listed. The resistor R issues the ionic current detection signal Ei as previously mentioned.

Thus, adding the diodes 18A through 18D for making the ionic current i flow between the central electrode 15 and the peripheral electrodes 16A through 16D enables the invention to be applied also to the internal-combustion engine wherein high voltage is distributed, and the same operations and advantages as those described above will be obtained.

Furthermore, there will be no increase in cost since the single zener diode 6 and the single ionic current detecting circuit 10A can be shared by the spark plugs 4A through 4D of each cylinder.

In this embodiment also, a DC power supply may be employed in place of the capacitor C and the charging circuit of the capacitor C as described previously.

As in the case of the third embodiment shown in FIG. 2, the current limiting means 11 may be added in this embodiment.

Fifth Embodiment

In the foregoing first through third embodiments, only one spark plug 4 has been representatively used for the description; however, it is obvious that the present invention can also be applied to an internal-combustion engine apparatus having a plurality of ignition coils and a plurality of spark plugs for each cylinder.

In such a case also, the single voltage clamping means, namely, a zener diode 6, and a single ionic current detecting circuit lOA can be shared by the plurality of ignition coils and spark plugs for each cylinder, causing no increase in cost.

Figure 4:
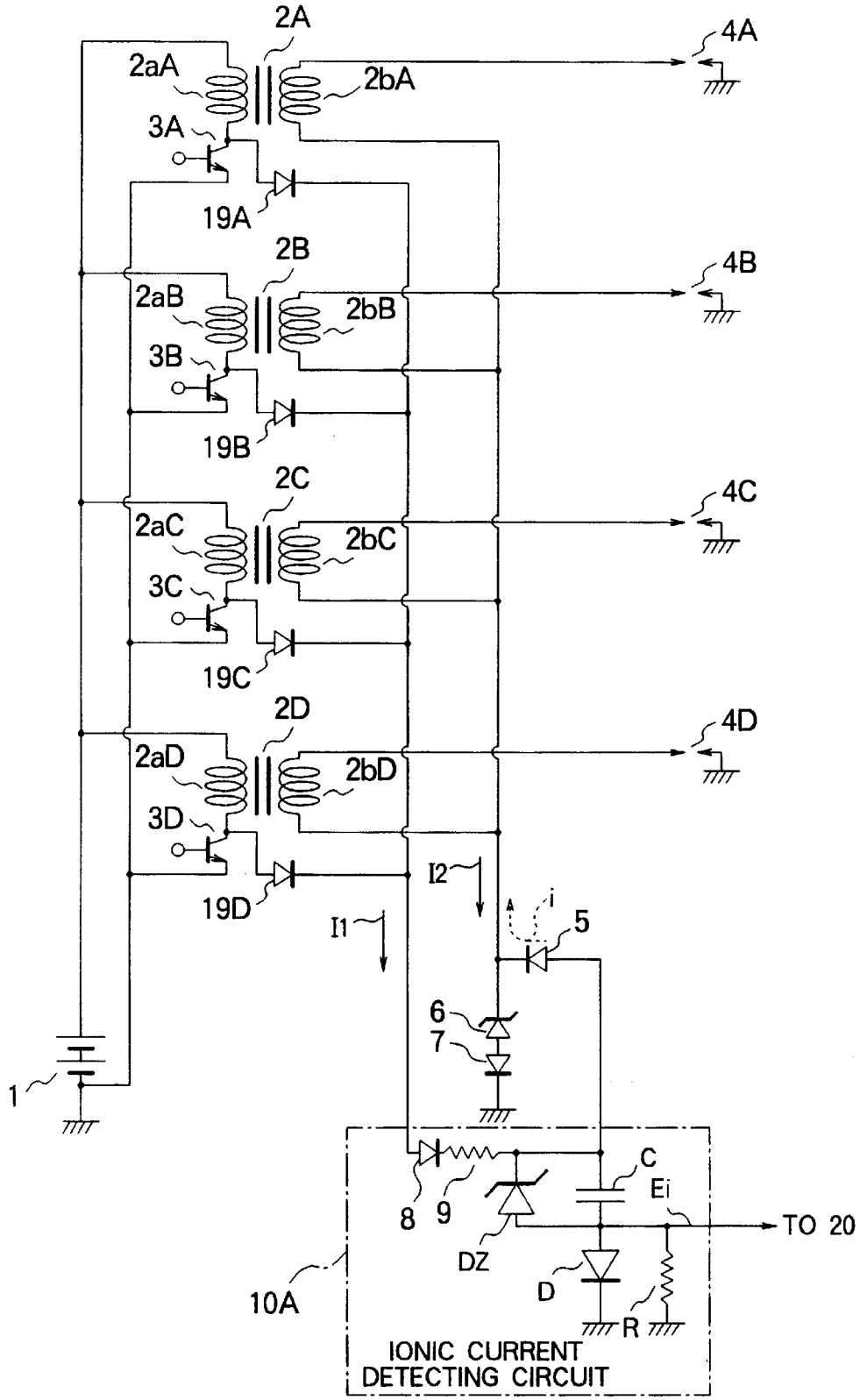
FIG. 4 is a circuit block diagram illustrating a fifth embodiment of the invention.

FIG. 4 is a circuit block diagram illustrating a fifth embodiment of the invention applied to a four-cylinder independent ignition device; like components as those shown in FIG. 1 will be assigned like reference numerals and the detailed description thereof will be omitted.

In FIG. 4, ignition coils 2A through 2D provided for the four cylinders have the same configuration; they respectively have primary windings 2*a*A through 2*a*D and secondary windings 2*b*A through 2*b*D.

Spark plugs 4A through 4D provided in the combustion chambers of the cylinders are individually connected to the high voltage ends of the secondary windings 2*b*A through 2*b*D of the ignition coils 2A through 2D.

The cathode of a battery 1 is connected to one end of the primary windings 2*a*A through 2*a*D of the ignition coils 2A through 2D; the other ends of the primary windings 2*a*A through 2*a*D are individually connected to the collectors of power transistors 3A through 3D.

The other ends of the primary windings 2*a*A through 2*a*D are all connected to the anode of a diode 8 in an ionic current detecting circuit 10A via diodes 19A through 19D.

The diodes 19A through 19D serve to let primary current I1, which is provided by the counter electromotive voltage produced when the power transistors 3A through 3D are turned OFF, flow into a capacitor C for charging bias voltage, and to prevent the mutual interference of secondary current I2 of other ignition coils.

The low voltage ends of the secondary windings 2*b*A through 2*b*D of the ignition coils 2A through 2D are all connected to the junction of a diode 5 and a zener diode 6 and grounded via a voltage clamping means composed of the zener diode 6 and a diode 7.

The operation of the fifth embodiment of the invention shown in FIG. 4 will now be described.

For the purpose of simplicity, an example will be taken wherein the ignition control is conducted using the spark plug 4A.

The power transistor 3A is turned ON/OFF to initiate or stop the supply of the primary current I1; when the primary current I1 is cut off, primary voltage appears at the collector of the power transistor 3A, and the primary current I1 for changing the bias voltage flows along a path composed of a diode 19A, the diode 8, a resistor 9, the capacitor C, a diode D, and the ground in the order in which they are listed, thus charging the capacitor C.

When the accumulated voltage of the capacitor C reaches the predetermined bias voltage VBi, the charging of the capacitor C is competed; after that, the primary current I1 flows along a path composed of the diode 19A, the diode 8, the resistor 9, the zener diode DZ, the diode D, and the ground in the order in which they are listed.

At the secondary winding 2*b*A which carries out ignition control on the spark plug 4A, the secondary current I2 flows through the zener diode 6, generating the clamping voltage Vc which satisfies the foregoing equation (1).

Following the combustion, as soon as the clamping voltage Vc drops to a value that satisfies equation (2), the ionic current i flows via the spark plug 4A and the ionic current detecting circuit 10A, and the ionic current detection signal Ei is issued.

Thus, even when the invention is applied to the independent ignition device with a plurality of cylinders, the same operations and advantages as those of the embodiments above can be obtained.

Highly accurate ionic current detection signal Ei which permits highly reliable determination results of combustion states of the internal-combustion engine can be achieved without adding to cost by connecting the single zener diode 6 and the ionic current detecting circuit 10A to all the ignition coils 2A through 2D for each cylinder.

A DC power supply may be employed in place of the capacitor C and the charging circuit of the capacitor C, or a current limiting means 11 may be added as in the case of the third embodiment illustrated in FIG. 2.

What is claimed is:

1. A combustion state detecting apparatus for an internal-combustion engine, comprising:

an ignition coil composed of a transformer which has a primary winding and a secondary winding, and which generates a high voltage for ignition at a high voltage end of the secondary winding when supply of current to the primary winding is cut off;

a spark plug, comprising opposed electrodes, connected to the high voltage end of the secondary winding and which discharges under application of a high voltage for ignition to ignite a fuel-air mixture in a cylinder of the internal-combustion engine;

an ionic current detecting circuit which includes biasing means connected to a low voltage end of the secondary winding and which detects ionic current flowing from the biasing means via the spark plug after the combustion of the fuel-air mixture;

rectifying means, inserted between the biasing means and the low voltage end of the secondary winding, for controlling flow of the ionic current in a forward direction;

voltage clamping means, inserted between the low voltage end of the secondary winding and ground; and an ECU which detects a combustion state at the spark plug according to the ionic current;

wherein the biasing means applies a bias voltage of a polarity opposite to the high voltage for ignition to the spark plug via the rectifying means and the secondary winding; and the voltage clamping means limits the voltage at the low voltage end of the secondary winding to a predetermined value when the high voltage for ignition appears;

an absolute value of the predetermined value being set to the absolute value or more of the bias voltage of the biasing means, and wherein:

current limiting means is installed between the junction of the rectifying means and the voltage clamping means and the low voltage end of the secondary winding; and the current limiting means controls the current flowing from the biasing means to the spark plug via the secondary winding so as to control the voltage at the high voltage end of the secondary winding when current begins to be supplied to the primary winding, and wherein the current limiting means comprises a resistor and a diode connected in parallel to each other; and the diode sets the direction of the secondary current flowing through the secondary winding at the time of applying the high voltage for ignition to the forward direction so as to suppress a potential difference across the resistor during ignition control.

2. A combustion state detecting apparatus for an internal-combustion engine according to claim 1, wherein the voltage clamping means comprises a zener diode connected in opposite polarity with respect to a secondary current flowing through the secondary winding under the high voltage for ignition.

3. A combustion state detecting apparatus for an internal-combustion engine according to claim 1, wherein:

the biasing means comprises a capacitor which is charged with primary current flowing through the primary winding; and the ionic current detecting circuit comprises:

a diode having an anode connected to the low voltage end of the primary winding, and a resistor inserted between a cathode of the diode and the high voltage terminal of the capacitor.

4. A combustion state detecting apparatus for an internal-combustion engine according to claim 1, further comprising a distributor installed between the high voltage end of the secondary winding and the spark plug;

wherein the distributor comprises:

a central electrode connected to the high voltage end of the secondary winding, a plurality of peripheral electrodes individually connected to spark plugs of respective cylinders, a rotary electrode which rotates around the central electrode as the internal-combustion engine rotates and which is opposed to the peripheral electrodes in sequence with a gap therebetween, and a plurality of high voltage diodes individually provided between the central electrode and the respective peripheral electrodes so as to make the ionic current flow in the forward direction.

5. A combustion state detecting apparatus for an internal-combustion engine according to claim 1, wherein:

ignition coils and spark plugs are provided for respective cylinders of the internal-combustion engine; and the voltage clamping means and the ionic current detecting circuit are commonly connected to the low voltage ends of the secondary windings of the respective ignitions coils.

* * * * *